US005910081A

United States Patent [19]

Graham

[11] Patent Number: 5,910,081

[45] Date of Patent: Jun. 8, 1999

[54] MATTRESS COVER

[75] Inventor: Theodore J. Graham, Cincinnati, Ohio

[73] Assignee: Casco Products, Inc., Cincinnati, Ohio

[21] Appl. No.: 09/058,527

[22] Filed: Apr. 10, 1998

[51] Int. Cl.[6] ..... A47C 27/00

[52] U.S. Cl. ..... 5/699; 5/738

[58] Field of Search ..... 5/737, 738, 484, 5/699

[56] References Cited

U.S. PATENT DOCUMENTS

| | | | |
|---|---|---|---|
| 2,879,524 | 3/1959 | Eisen | 5/484 |
| 3,287,749 | 11/1966 | Marsico | 5/738 X |
| 3,581,322 | 6/1971 | Marsico | 5/738 X |
| 4,164,797 | 8/1979 | Golembeck | 5/738 |

*Primary Examiner*—Michael F. Trettel

*Attorney, Agent, or Firm*—Wood, Herron, & Evans, LLP

[57] ABSTRACT

The present invention provides a mattress cover that is resistant to liquid migration. The cover top has an unbroken surface, that is, a surface without a stitch line or needle holes in that part of the cover which may be subjected to body fluids. In a preferred embodiment, the mattress cover top is secured to a mattress cover bottom by a tooth-type zipper. A bridge strip is bonded to the cover top, and a zipper top component is stitched to this bridge strip. The cover top's edge is folded to form a protective flap, and the zipper top component is also sewn to the upturned portion of the flap, as well as the bridge strip so the bridge strip allows the upturned flap and zipper top component to be connected to the cover's inner side through the bridge strip. When the zipper top component and zipper bottom component are locked together, the protective flap on the top cover overlays both the locked zipper and the stitch line created by stitching the lower zipper to the bottom cover.

16 Claims, 1 Drawing Sheet

MATTRESS COVER

FIELD OF THE INVENTION

This invention relates to mattress covers and more particularly, fluid resistant removable mattress covers.

BACKGROUND OF THE INVENTION

In the past, it has been common to manufacture mattress covers by sewing an envelope-like cover, and then fitting the cover, over the mattress interior, including internal padding components, through a zipper closure. This type of cover is of particular use in hospitals and similar institutional settings in which many people are housed and cared for by a separate staff. The envelope-like construction of the mattress cover saves cost of replacing internal padding components by just replacing cover.

In this prior art type mattress cover, the cover itself is frequently formed by stitching the top and bottom sections of the envelope-like cover together, and by providing a fastener such as a zipper in the place of a stitched seam around a portion of the cover, so that the cover can be easily and quickly removed from the mattress for cleaning and replacement. In hospital settings, often the patients are convalescing from ailments which prevent them from caring for themselves and which causes them to soil their bedding with bodily fluids. Since cleanliness is a primary concern in this environment, mattress covers are changed often in order to allow the patient to remain comfortable and to continue to heal.

Traditionally, when a zipper is attached to the top and bottom of an envelope-like cover to provide the fastener, it has been attached by industrial sewing apparatus which generates a regular stitch line between the zipper tape and the cover material. When a zipper half is sewn to the top cover, the sewing operation generates needle holes in the mattress cover through which various thread materials are used to secure the zipper tape onto the cover. In such construction, fluids may migrate through these stitch holes, come in to contact with the mattress's, internal padding components, and contaminate the entire mattress. When this happens, the mattress may be permanently soiled by patient body fluids and other fluids that may not only propagate unpleasant odors, but may also pose a real health threat to the institution's staff and the next patient, and which may require premature mattress replacement.

SUMMARY OF THE INVENTION

It is an objective of this invention to provide a removable mattress cover that is resistant to liquid migration through the cover.

It is a further objective of this invention to provide a removable mattress cover with an unbroken surface, that is, a surface without a stitch line or needle holes in that part of the cover which may be subjected to body fluids.

These and other objectives of the invention are achieved by providing, in preferred form, a mattress cover top secured to a mattress cover bottom by a tooth-type zipper. The zipper is secured to the cover, however, in a unique way to avoid creation of a stitch line in the cover exposed to fluids. In particular, in one embodiment, a bridge strip is radio frequency heat sealed ("RF sealed"), to the fluid resistant cover top. The cover top's edge is folded to form a protective flap, and the zipper top component and the upturned portion of the flap is sewn to the bridge strip so the bridge strip allows the upturned flap and zipper top component to be connected to the cover's inner side but without a stitch line extending through the cover. Since the bridge strip is RF sealed to the cover's inner side the fluid resistant integrity of the cover when exposed to undesirable fluids is, thereby, insured. The zipper bottom component is stitched to the cover bottom's edge which has also been folded over, but the flap of the cover's top member overlaps this edge and fluids do not migrate into this area.

When the mattress cover is fitted to a mattress, the zipper is pulled closed, the two zipper components locking together, and thus closing the opening otherwise created by the unsecured zipper. When the two zipper-halves are locked together, the protective flap on the top cover overlays both the locked zipper and the stitch line created by stitching the lower zipper to the cover bottom member. Any fluids on the cover top member simply dribble or flow over the cover and down the side below the protective flap.

Thus, it will be appreciated that there is no exposed stitch line which extends through the cover top member and, therefore, there are no vulnerable needle holes through which fluid or liquid can migrate. The RF seal secures the bridge strip to the inner side of the cover top member without stitch holes at the sealed point.

Other advantages of the invention will become more apparent to those of ordinary skill upon review of the following detailed description of the preferred embodiment taken in conjunction with the accompanying drawings.

DETAILED DESCRIPTION

Figure 1:
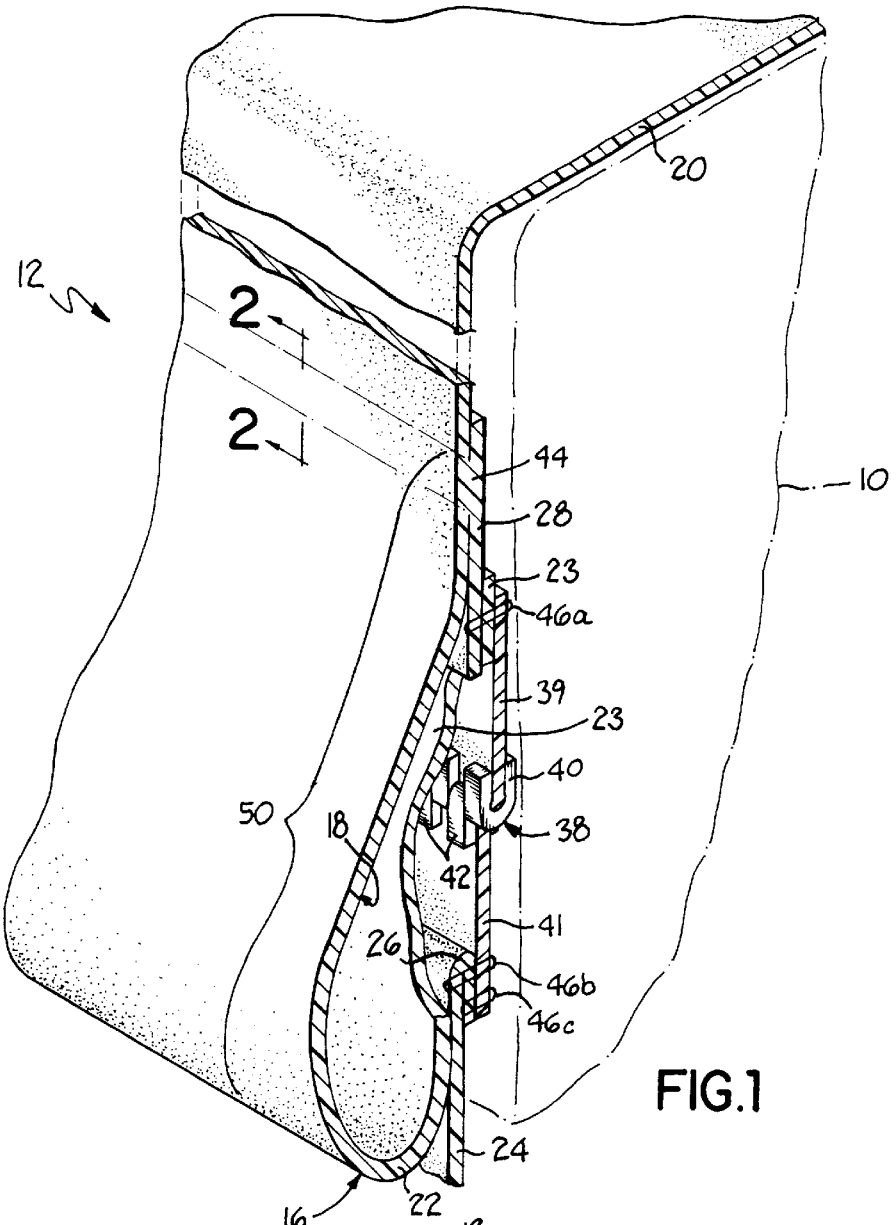
FIG. 1 is a perspective cutaway view of a mattress cover fitted and secured around a mattress.
Figure 2:
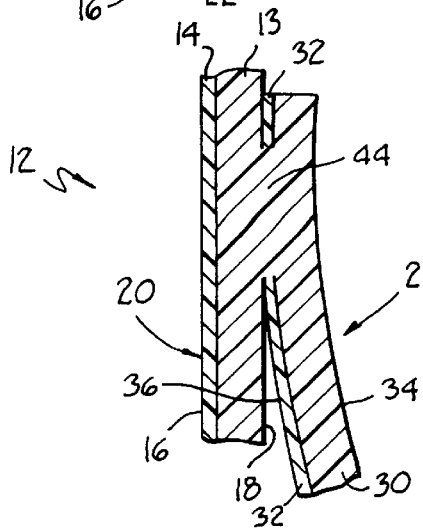
FIG. 2 is a cross section taken along lines 2—2 of FIG. 1 as having the RF bond for the mattress cover along the phantom lines shown in FIG. 1.

As seen in FIGS. 1 and 2, a mattress cover 12 in accord with the principles of this invention is fitted around mattress internal padding components 10. The mattress cover 12 has an outer side 16 and an inner side 18. The cover 12 includes a cover top member 20 and a cover bottom member 24 and is formed of a primary material 13 with a primary liquid barrier layer 14 applied thereto. In the preferred embodiment, the primary material 13 for the cover top member 20 is stretch nylon, type 6 or type 66 and the primary material 13 for the cover bottom member 24 is vinyl or scrim laminate. In the preferred embodiment, the primary liquid barrier layer 14 on the cover top member 20 is formed with a polyurethane coating and on the cover bottom member 24 is formed with a vinyl coating.

A bridge strip 28 is attached to the inner side 18 of the cover top member 20, and has a first side 34 and a second side 36. The bridge strip 28 is made of a strip material 30 to which a polyurethane layer 32 is applied. In the preferred embodiment, the strip material 30 is four hundred denier nylon pack cloth. The bridge strip 28 is attached to the inner side 18 of the cover top member 20 by a radio frequency created seal ("RF seal"), by which the cover top member 20 and the bridge strip 28 are fused together.

The cover 12 has a locking member 38 which closes the cover top member 20 to a cover bottom member 24. The locking member 38 has a top web 39 to which top teeth 40 are attached. The locking member 38 in the preferred embodiment is a zipper, but it will be appreciated that other locking members could be used. The top web 39 overlays the now turned under outer side 16 of the cover top member 20. The top web 39 is attached to the return member 23 and to the bridge strip 28 with a top thread stitch line 46*a*, thereby attaching the top web 39 to the cover top member 20. The top teeth 40 of the locking member 38 intermesh with the bottom teeth 42 in order to hold the cover top member 20 and the cover bottom member 24 securely together.

The cover top member 20 is folded along an elongated top fold 22 to define a return member 23 so that the inner side 18 of top member 20 faces itself to form a protective depending flap 50 defined between the RF seal at 44 to the strip 28 and the elongated fold 22. Prior to being folded, the cover top member 20 is sewn so as to attach the inner side 18 of the cover top member 20 against the first side 34 of the fabric bridge 28 and the outer side 16 to the zipper web 39.

The cover bottom member 24 has an elongated fold 26 at which the cover bottom member 24 is folded back upon itself. The bottom web 41 of the locking member 38 is secured to the cover bottom member 24 by two bottom thread stitch lines 46*b*, 46*c* so that the bottom thread stitch line 46*b* passes through both the bottom web 41 and the bottom fold 26 and the bottom thread stitch line 46*c* passes through the bottom web 41 and the margin of the cover bottom member 24. When the cover 12 is fitted around the mattress 10 and the locking member 38 is secured so that the top teeth 40 intermesh with the bottom teeth 42, the flap 50 overlays both the locking member 38 and the bottom thread stitch line 46*b*.

Accordingly, the locking member 38 is attached through bridge strip 28 to the inside surface of cover top member 20 by RF sealing and there is no stitch line or needle hole therethrough in the upper portion of the cover. The flap 50 extends over the locking member 38 and the bottom thread stitch line 46*b* securing the locking member 38 to the cover bottom member 24. Any fluids spilling on the mattress cover 12 simply flow over the flap 50 and off, and do not contaminate the mattress internal padding components 10 through any holes in the cover 12 or through the locking member 38.

It will be appreciated that any other suitable form of bonding of the bridge strip 28 to cover 20 can be used. RF sealing is simply the preferred seal for this embodiment. It will be appreciated that while a slight depression may appear at the RF seal 44, the materials are not negatively compromised by any such deformation. It will also be appreciated that other materials could be used to form the components described herein and other bonding techniques or adhesives used. It will also be appreciated that the return member 23 secured to the bridge strip 28 and the zipper web 39 could be oriented together as shown or selectively on either side of the bridge strip 28. The zipper web 41 could be disposed on either side of the bottom fold 26.

It will also be appreciated that, as described above, the flap 50 is long enough to extend over the locking member 38 and over the bottom fold 26 to deflect fluids thereover.

Finally, it will be appreciated that the flap 50 (i.e. at fold 22) extends along the full extent of locking member 38 so there is no path of ingress into the interior of cover 20 as disposed in normal use.

Additional advantages and modifications will readily appear to those skilled in the art without departing from the scope of this invention. The invention in its broader aspects is therefore not limited to the specific detail, representative apparatus and illustrative example shown and described. This has been a description of the present invention as currently known. Applicant intends to be bound only by the appended claims.

What is claimed is:

1. A fluid barrier mattress cover having a top member and a bottom member, each of said top and bottom members having outer and inner sides, a bridge strip having first and second sides, said bridge strip being bonded to said inner side of said cover top member, without creating any fluid access through said bridge strip and said cover top member along said bond, a closure having first and second complimentary locking components for closing said cover top member to said cover bottom member, said first locking component being secured to said bridge strip such that the outer side of the cover top member is not pierced by any openings and said second locking component being secured to said cover bottom member.

2. The mattress cover of claim 1, wherein said cover top member is folded so that said inner side is located against said first side of said bridge strip, and so that said first locking component is located against said outer side of said cover top member, all of said bridge strip, first locking component and cover top member being attached together with said bridge strip and said first locking component thereby disposed on opposite sides of the cover.

3. The mattress cover of claim 1, wherein said cover is fabricated from stretch nylon, type sixty-six.

4. The mattress cover of claim 1, wherein said bridge strip is fabricated from four hundred denier nylon pack cloth.

5. The mattress cover of claim 1, wherein a coating of polyurethane is applied to said outer side of said cover.

6. The mattress cover of claim 1, wherein a coating of polyurethane is applied to said second side of said bridge strip.

7. The mattress cover of claim 1, wherein said bridge strip is attached to said cover by a radio frequency generated bond.

8. The mattress cover of claim 1, wherein said first and second complimentary locking components are the upper and lower jaws, respectively, of a tooth-type zipper.

9. The mattress cover of claim 1, wherein said first locking component is secured by a line of stitching to said bridge strip.

10. The mattress cover of claim 1, wherein said second locking component is secured by a line of stitching to said cover bottom member.

11. The mattress cover of claim 1, wherein said cover bottom member is folded so that said inner side is located against itself, and wherein said second locking component is located against said outer side of said cover bottom member and overlays said fold.

12. A mattress cover, comprising:

a cover top member and a cover bottom member, each of said cover top and cover bottom members having inner and outer sides, said cover top member being made from stretch nylon, type sixty-six, said cover bottom member being made from one of the group comprising vinyl or scrim laminate, said outer side of said cover top member being coated with polyurethane, said outer side of said cover bottom member being coated with vinyl, said cover top member being folded back upon itself to form a cover top return member, a bridge strip having first and second sides and being made of four hundred denier nylon pack cloth, said second side being coated with polyurethane, said second side of said bridge strip being radio frequency bonded to said inner side of said cover top member, a tooth-type zipper closure having first and second complimentary locking components, said first locking component being attached to said outer side of said cover top return member and said second locking component being attached to said cover bottom member, at least one top line of stitching extending through said first locking component, said cover top member, and said bridge strip, securing them together, and at least one bottom line of stitching extending through said second locking component and said cover bottom member, securing them together.

13. A mattress cover, comprising:

a cover top member and a cover bottom member, each of said cover top and cover bottom members having inner and outer sides, said cover top member being made from stretch nylon, type 6, said cover bottom member being made from scrim, said outer side of said cover top member being coated with polyurethane, said outer side of said cover bottom member being coated with vinyl, said cover top member being folded back upon itself to form a cover top return member, a bridge strip having first and second sides and being made of four hundred denier nylon pack cloth, said second side being coated with polyurethane, said second side of said bridge strip being radio frequency bonded to said inner side of said cover top member, a tooth-type zipper closure having first and second complimentary locking components, said first locking component being attached to said outer side of said cover top return member and said second locking component being attached to said cover bottom member, at least one top line of stitching extending through said first locking component, said cover top member, and said bridge strip, securing them together, and at least one bottom line of stitching extending through said second locking component and said cover bottom member, securing them together.

14. A mattress cover secure against ingress of fluids deposited on said cover, and having a cover top member and a cover bottom member, said cover top member comprising:

an elongated flap of mattress cover material reversed upon itself, a bridge strip secured to an inner side area of said cover top member without creating openings or any fluid access through said bridge strip and said cover top member along the area where the bridge strip and the cover top member are secured, said bridge strip also secured to an edge of said cover top member to form said flap;

a first component of a two-component locking member secured to said bridge strip, a second component of said two-component locking member secured to said cover bottom member, and said flap extending over said locking member when said two components thereof are joined together over a mattress.

15. The mattress cover of claim 14, wherein said bridge strip has one edge secured to said cover top member and a parallel edge secured to both said cover top member edge and to said first component of said locking member.

16. The mattress cover of claim 15, wherein said cover top member edge and said first locking component of said locking member are secured on the same side of said parallel edge of said bridge strip.

* * * * *